United States Patent [19]

Choi

[11] Patent Number: 4,573,333

[45] Date of Patent: Mar. 4, 1986

[54] ELECTRICAL DOOR LOCK

[76] Inventor: Yoon H. Choi, 46-3, Changchun-Dong, Sudaemoon-ku, Seoul, Rep. of Korea

[21] Appl. No.: 524,602

[22] Filed: Aug. 19, 1983

[51] Int. Cl.[4] ..... E05B 47/06

[52] U.S. Cl. ..... 70/279; 292/18; 292/78; 292/201; 292/210; 292/DIG. 24

[58] Field of Search ..... 70/277–283; 292/169.13, 201, 210, 70, 79, 78, 18, 14, DIG. 24

[56] References Cited

U.S. PATENT DOCUMENTS

| | | | |
|---|---|---|---|
| 830,545 | 9/1906 | Voight | 292/210 X |
| 1,514,528 | 11/1924 | Hurd | 292/DIG. 24 |
| 1,949,850 | 3/1934 | Willard | 292/201 X |
| 2,003,731 | 6/1935 | Beito | 292/210 X |
| 2,293,700 | 8/1942 | Curtiss, Jr. | 292/78 X |
| 2,848,263 | 8/1958 | Miller | 292/210 X |
| 3,122,388 | 2/1964 | Powers | 292/201 X |
| 3,337,250 | 8/1967 | Russell et al. | 292/210 |
| 3,359,767 | 12/1967 | Arlauskas et al. | 292/201 X |
| 3,652,113 | 3/1972 | Odend'hal et al. | 292/210 X |
| 4,056,276 | 11/1977 | Jarvis | 292/201 |

FOREIGN PATENT DOCUMENTS

| | | | |
|---|---|---|---|
| 1035514 | 7/1958 | Fed. Rep. of Germany | 292/201 |
| 482149 | 6/1953 | Italy | 292/201 |
| 18033 | of 1890 | United Kingdom | 292/210 |

*Primary Examiner*—Kenneth J. Dorner
*Assistant Examiner*—Lloyd A. Gall
*Attorney, Agent, or Firm*—Wender Murase & White

[57] ABSTRACT

An electric door lock having a return means comprising a pair of locking members, a return member, rod guides, and leaf springs which eliminates the disadvantages of roller type pivot member locks. The lock is thinner to provide improved appearance. The locking members and return member may be connected to each other to ensure more reliable operation. A biasing force is applied to the locking members in the same direction as the pivotal movement of the locking members, and the engaging surface of the locking members does not apply force to the locking levers thereby making it possible to disengage the locking lever from the locking members using only a minimum of magnetic force and consuming only a small amount of electric power which can be conveniently supplied by a small DC battery.

6 Claims, 16 Drawing Figures

ELECTRICAL DOOR LOCK

FIELD OF THE INVENTION

The present invention relates generally to an electrical door lock, and more particularly to an electrical door lock which may be reliably unlocked using only a small force.

BACKGROUND OF THE INVENTION

Hitherto, various types of the door locks have been proposed. For example, an electrical door lock is known which comprises a roller-type pivot member which functions to operate as both a locking member and a return member, and which carries a spring adapted to urge the pivot member towards an unlocked position. However, since the pivot member is biased towards an unlocked position by the spring, a relatively large load must be applied to the locking member in order to engage the pivot member and hold the pivot member in its locked position. Conversely, when unlocking the door lock, disengagement of the locking member also requires a large force, resulting in a waste of electrical power. Further, regardless of whether the door lock is locked or unlocked, the pivot member always protrudes outwardly from the lock housing. Accordingly, when the door lock is disposed on the interior side of the door, the pivot member protrudes outwardly and laterally from the door, preventing the door from fully closing. Therefore, such door locks can only be mounted on the outer surface of the door thus detracting from its overall appearance.

SUMMARY OF THE INVENTION

Accordingly, a primary object of the present invention is to provide an electrical door lock which is capable of eliminating the problems encountered in conventional electrical door locks.

Another object of the present invention is to provide an electrical door lock comprising two locking members and a return member, wherein reversed pivoting forces are applied respectively to the locking member and return member upon locking and unlocking the door lock, so that the door lock can be released by a small force, resulting in the saving of electrical power and extending the shelf life of the battery used as a power source for the lock.

Another object of the present invention is to provide an electrical door lock comprising one or two locking members and a return member, wherein each of the locking members and the return member pivotally extend from and retract into the housing, upon locking and unlocking of the door lock respectively, so that the door lock can easily and simply be mounted on an interior surface of the door thereby improving the appearance of the door.

It is a further object of the invention to provide an electrical door lock which is compatible with existing mechanical door locks.

A further object of the invention is to provide an electrical door lock comprising one or two locking levers depending on the number of locking members, wherein each locking lever is firmly engaged with an engaging surface of a respective locking member when the locking member is in a protruded or locked position and disengaged rapidly and reliably from the engaging surface of the locking member upon unlocking the door lock, for reliable locking and unlocking the door lock.

Another object of the present invention is to provide an electrical door lock comprising a releasing means for holding a locking lever in an unlocked position, wherein the door lock is maintained in the unlocked position so that the door can be freely opened or closed as desired.

A still further object of the invention is to provide an electrical door lock comprising both an automatic unlocking means for automatically releasing the locking lever from engagement with the locking member by means of an electrical signal and a manual unlocking means, so that the door lock can be either automatically or manually unlocked, as desired.

In accordance with the invention, these and other objects are accomplished by providing an electrical door lock comprising a housing preferably mounted on an interior of a door body. One or preferably a pair of locking members are pivotally mounted on opposing side walls of the housing by means of a pair of first pins, each of the first pins being fixed to an intermediate corner of a locking member. A return member is pivotally mounted on a side wall of the housing by a second pin which is fixed to an intermediate corner of the return member. Where a pair of locking members are used, three connecting rods are provided, each having a coil spring wrapped therearound. Two of the connecting rods are connected to the locking member at one end, the remaining connecting rod being connected to the return member at one end. A pair of rod guides are pivotally connected to the opposing side walls of the housing and arranged across the connecting rods. A first of the rod guides has two holes, each of which slidably receives the other end of the connecting rods which are connected to the locking member, a second of the rod guides has a hole for slidably receiving the other end of the connecting rod which is connected to the return member. Three leaf springs or the like are provided. Two of the leaf springs are fixed to the first rod guide at one end and contactable with a curved surface of the locking member at the other end. The third leaf spring is fixed at one end to the second rod guide and contactable with a curved surface of the return member at its other end. A pair of locking levers are disposed adjacent respective locking members for engaging the engaging surfaces of locking members to hold the locking members in the locked positions. A pair of actuating levers are provided for disengaging the locking levers from the engaging surfaces of locking members. One of the actuating levers preferably has a back end with a shoulder. All of the locking levers and the actuating levers are pivotally mounted to a third pin fixed to the housing. Two pairs of springs are wrapped around the third pin; one pair for applying a biasing force in one direction to the locking levers and the other pair for applying a biasing force in a reversed direction to the actuating levers. A plate, movable by means of an electrical magnet and engageable with the shoulder of the actuating lever, is provided. A manual unlocking means is disposed adjacent to the electrical magnet and operable for moving the plate. A pair of longitudinally moveable releasing levers is disposed behind each of the locking levers.

These and other objects and novel features of the invention will become apparent from the following description of a presently preferred embodiment of the invention and by reference to the accompanying drawings.

DESCRIPTION OF THE PREFERRED EMBODIMENT

Figure 1:
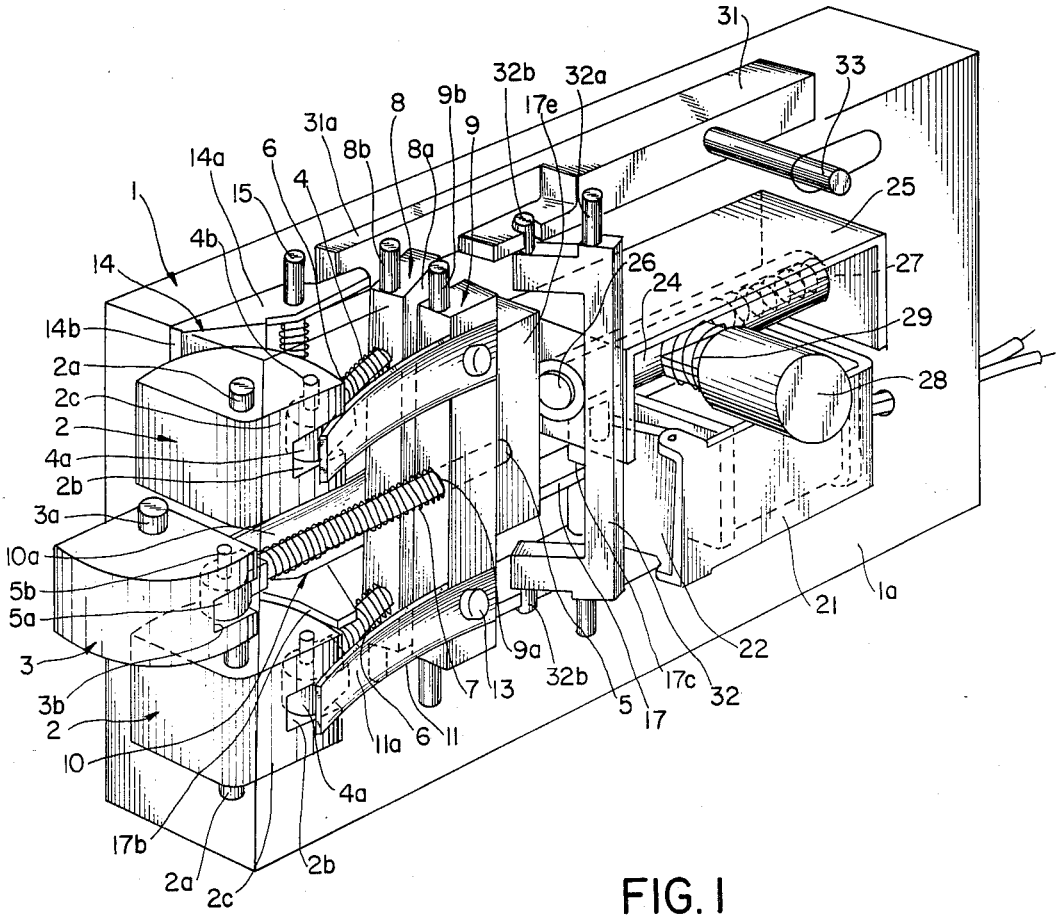
FIG. 1 is a perspective view of an overall construction of a door lock according to the invention.
Figure 2:
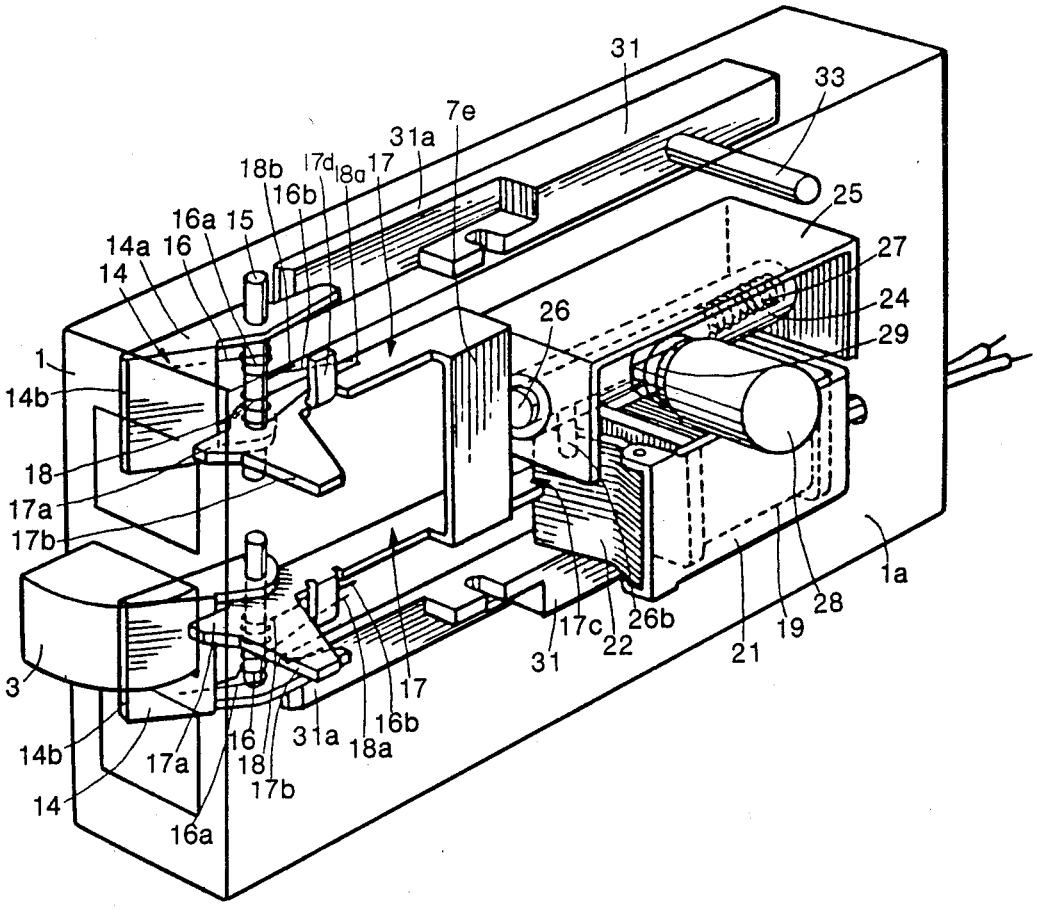
FIG. 2 is a partial perspective view of the door lock of FIG. 1, showing an inner construction thereof having a partial portion thereof removed.
Figure 3:
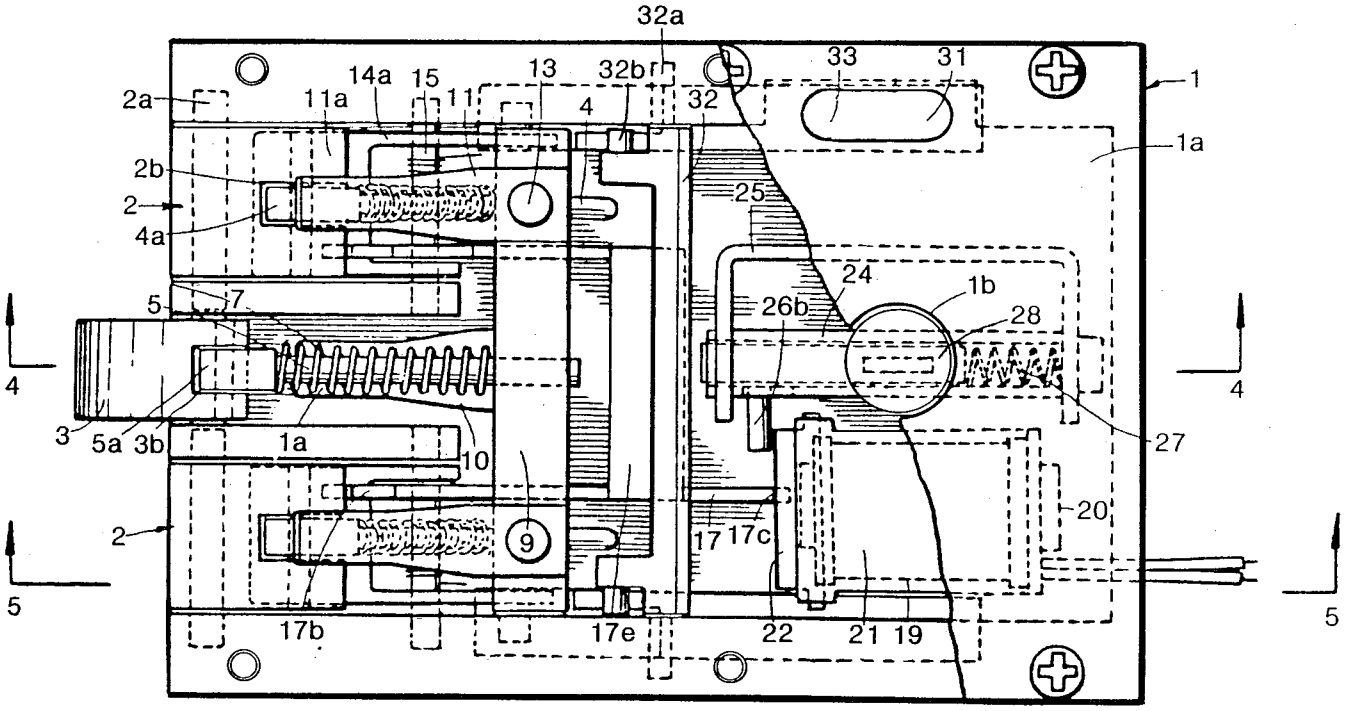
FIG. 3 is a top plane view of the door lock having a part of the upper wall of the housing cut away.

FIG. 1 illustrates a perspective view of the structural components of a door lock according to a preferred embodiment of the invention. The door lock has a housing 1 which is preferably fixed to the interior surface of a door body. The door lock also has at least one but preferably a pair of generally quadrant-shaped locking members 2 vertically aligned with each other, and a quadrant-shaped return member 3 positioned between and opposite to the locking members 2 and adapted to cause the locking members 2 to return from an extended position to a retracted position as described below in more detail. Each locking member 2 has a pivot pin 2*a* fixed to an intermediate corner thereof, the pivot pins 2*a* protruding upwardly and downwardly from the locking members 2 in order to enable locking members 2 to pivot with respect to the housing 1. The return member 3 also is provided with a pivot pin 3*a* fixed to an intermediate corner thereof in order to enable it to pivot with respect to the housing 1.

Each locking member 2 is provided at an edge near a corner thereof, with a recess 2*b* in which one end of a connecting rod 4 is pivotally connected to the locking member 2. The other end of the connecting rods 4 are slidably inserted into a hole 8*a* of the rod guide 8 which is pivotally mounted to the housing 1 by means of a pair of pins 8*b* which are fixed to upper and lower surfaces of the rod guide 8, respectively. Coil springs 6 are wrapped around the connecting rods 4 and are extended or compressed according to the movement of the connecting rods 4 through the holes 8*a* of the rod guides 8 by the pivotal movements of the locking member 2. Similarly, the return member 3 is provided at an edge near one corner thereof with a recess 3*b* in which one end 5*a* of connecting rod 5 is pivotally connected to the return member 3. The other end of the connecting rod 5 is slidably inserted into a hole 9*a* of a rod guide 9 which is pivotally mounted to the housing 1 by means of a pair of pins 9*b*, respectively fixed to upper and lower surfaces of the rod guide 9. A coil spring 7 is wrapped around the connecting rod 5 and is extended or compressed according to the movement of the connecting rod 5 through the hole 9*a* of the rod guide 9 by the pivotal movement of the return member 3.

One end of a leaf spring 10 is attached to the rod guide 8 by means of a bolt 12 such that the front end 10*a* is able to contact a side surface 3*c* of the return member 3, to apply a pivoting force to the return member during pivotal movement of the rod guide 8. Similarly, a pair of leaf springs 11 are attached to the rod guide 9 by means of bolts 13 such that a front end of each leaf spring 11 contacts a side surface 2*c* of each locking member 2, to apply a pivoting force to the locking members 2 during pivotal movement of the rod guide 9.

Adjacent to the locking members 2 and within the housing 1, a pair of locking levers 14 are pivotally mounted to the housing 1 by means of pins 15 fixed to upper and lower walls of the housing 1. Each locking lever 14 includes a lever portion 14*a*, and a locking portion 14*b* which extends downwardly from the front of the lever portion 14*a*. As described below, the front end of each locking portion 14*b* is selectively engageable with the engaging surface 2*c* of a respective locking member 2, thereby causing the engaged locking member 2 to be held in a locked position.

A pair of actuating levers 17 are pivotally mounted to the pins 15. The actuating levers 17 are integrally connected with each other by a connecting bar 17*e*. At the front end of each actuating lever 17, there is provided a first protrusion 17*a* adapted to depress the locking portion 14*b* of each locking lever 14, and a second protrusion 17*b* which extends laterally from the protrusions 17*a* and which is provided with an edge on which the curved surface of each locking member 2 is slidable. Each actuating lever 17 also has a spring support 17*d* at an intermediate portion thereof, and a shoulder 17*c* at a back end thereof. A first pair of coil springs 16 are wrapped around the pins 15 and a second pair of coil springs 18 are mated with said coil springs 16. Each coil spring 16 is supported at one end by the locking portion 14*b* of the locking lever 14 and at another end by the spring support 17*d* of the actuating lever 17 so that the coil springs 16 urge the locking levers 14 towards the engaging or locking position. Each coil spring 18 is supported at one end by a side wall 1*c* of the housing 1 and at another end by a spring support 17*d* such that the coil springs 18 urge the actuating levers 17 in the direction of causing the protrusions 17*a* to depress the locking portions 14*b* of the locking levers 14 towards their unlocking or disengaging positions.

A magnetic core 20 on which a magnetizing coil 19 is wrapped is disposed adjacent to a back end of the actuating levers 17. A plate 22 is pivotally mounted to a front end of a magnetizing iron 21 and is normally biased away from the front end of the core 20 by a spring 23. When the core 20 is not excited, the plate 22 is biased towards the actuating levers 17 and engages the shoulder 17*c*. When the core 20 is excited, the plate 22 retracts towards the core 20 causing it to disengage from the shoulder 17*c*.

Figure 4:
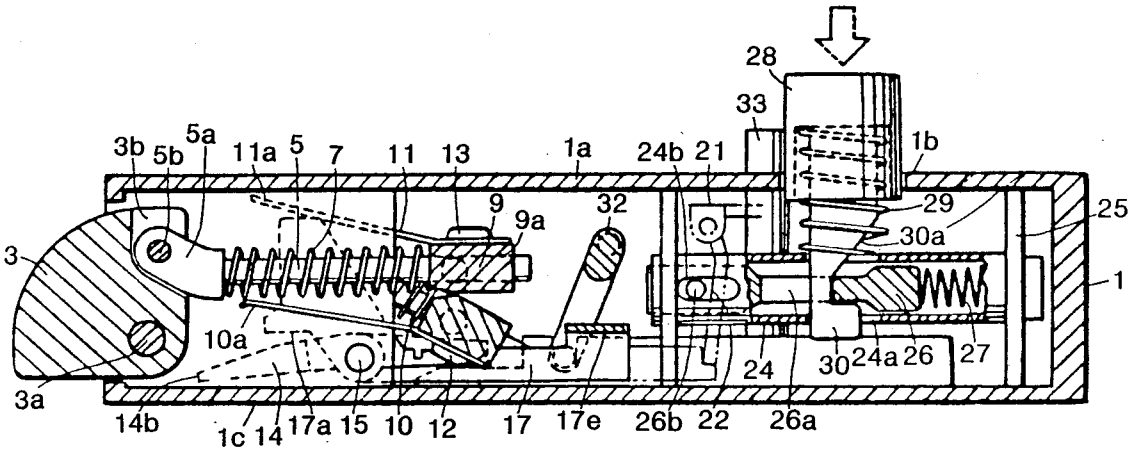
FIG. 4 is a cross-sectional view taken along line 4—4 of FIG. 3.
Figure 5:
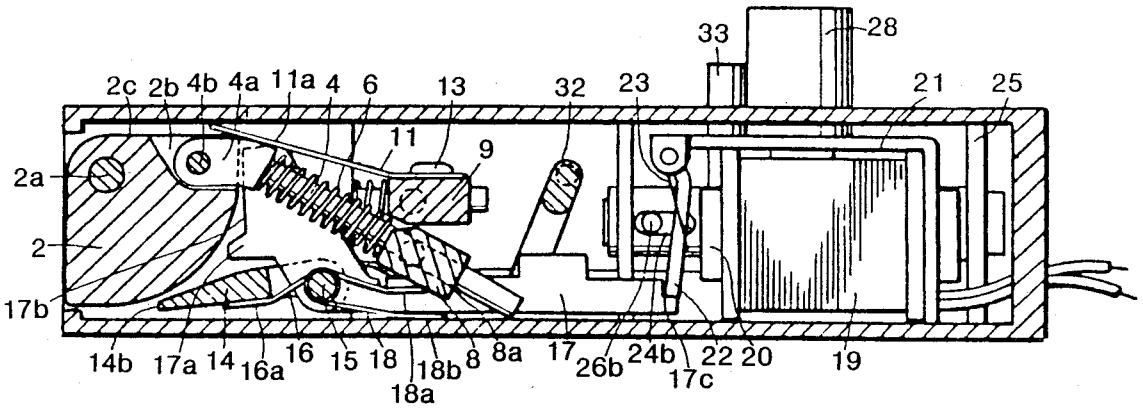
FIG. 5 is a cross-sectional view taken along line 5—5 of FIG. 3.

Above and generally parallel with the magnetic core 20, a cylinder 24 is supported by a supporting member 25 which is fixed to the housing 1 in a conventional manner. As seen in FIG. 4, the cylinder 24 has at an intermediate portion thereof a pair of vertically spaced, longitudinally extending slots 24*a*. Within the cylinder 24 a slider 26 is slidably disposed. A spring 27 is disposed between the slider 26 and back wall of the cylinder 24 and operates to bias the slider 26 to the left as viewed in FIG. 4. A longitudinally extending slot 26*a* is positioned at an intermediate portion of the slot 26 and carries, at a front portion thereof, a protrusion 26*b*. The protrusion 26*b* extends through a longitudinal slot 24*b* formed in the front of the cylinder 24. Movement of the slider 26 is limited by the slot 24*b* and the protrusion 26*b*. Retracting the slider 26, causes the protrusion 26*b* to contact the plate 22, thus causing the plate 22 to retract.

A push button 28 laterally aligned with the hole 24*a*, is inserted through a hole 1*b* formed in the lateral wall 1*a* of the housing 1. The push button 28 has a cam 30 with an inclined surface 30*a*. A coil spring 29 is wrapped around the cam 30 to bias the push button 28 outwardly. The free end of the cam 30 is inserted into the slot 24*a* of the cylinder 24 and the slot 26*a* of the slider 26. Movement of cam 30 caused by pushing the button 28, causes the inclined surface 30*a* of the cam 30 to contact the back edge of the slot 26*a*, causing the slider 26 and thus the plate 22 to retract.

A pair of releasing levers 31 are disposed adjacent to the locking levers 14. The releasing levers 31 are connected together by a connecting member 32 by means of a pair of pins 32*b* fixed to upper and lower surfaces of the connecting member 32. The connecting member 32 is pivotally mounted to the housing 1 by means of a pair of pins 32*a* fixed to its upper and lower surfaces. Accordingly, the releasing levers 31 are jointly and longitudinally movable, whereby the front end of each releasing lever 31 is selectively inserted between each locking lever 14 and the side wall 1*c* of the housing 1, causing the locking levers 14 to be held in an unlocking position. One of the releasing levers 31 preferably has at a back end thereof a knob 33 which protrudes outwardly from the housing 1 to permit manual manipulation of the releasing levers 31.

Figure 6A:
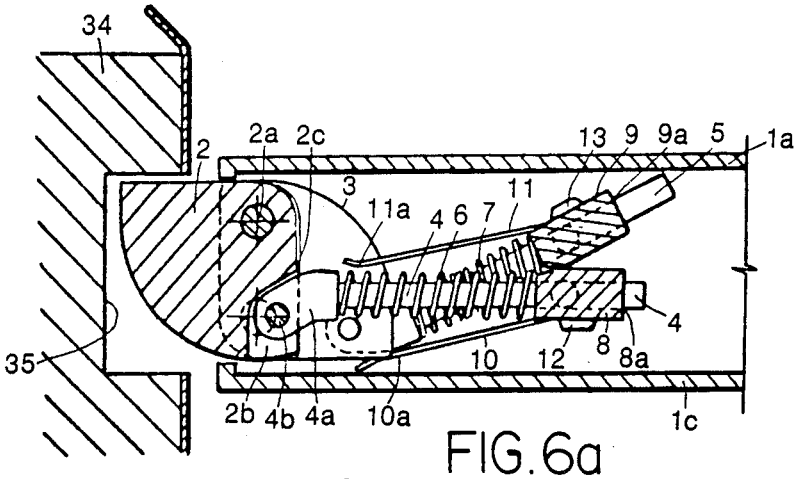
FIGS. 6(*a*)–(*c*) are partial, sectional views, showing sequential operations of the locking members and the return member when opening a door, FIG. 6(*a*) illustrating the door lock with the door completely closed, FIG. 6(*b*) illustrating the door lock with the door partially opened, and FIG. 6(*c*) illustrating the door lock with the door completely opened.
Figure 6B:
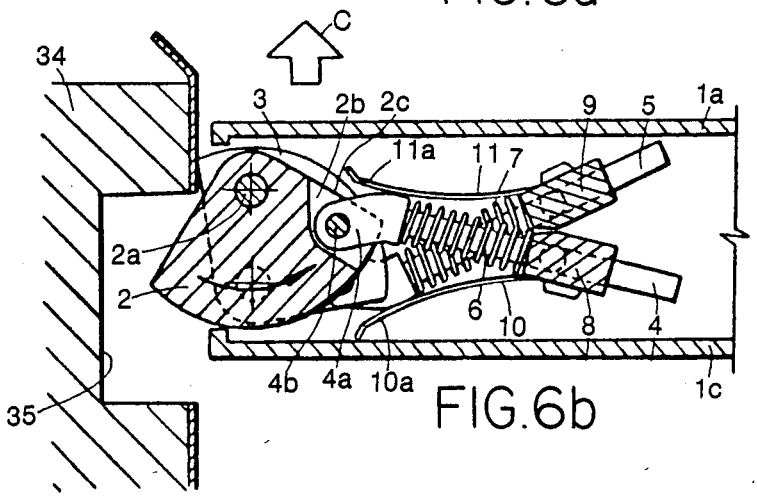
Figure 6C:
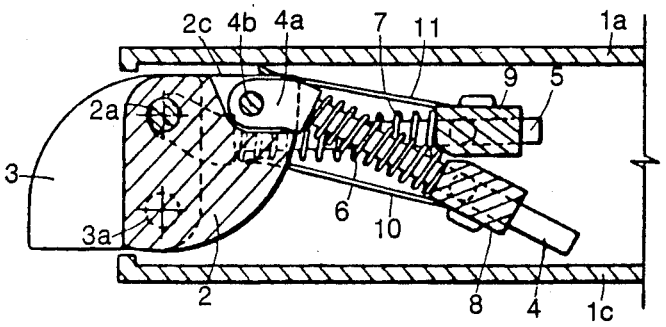
Figure 7A:
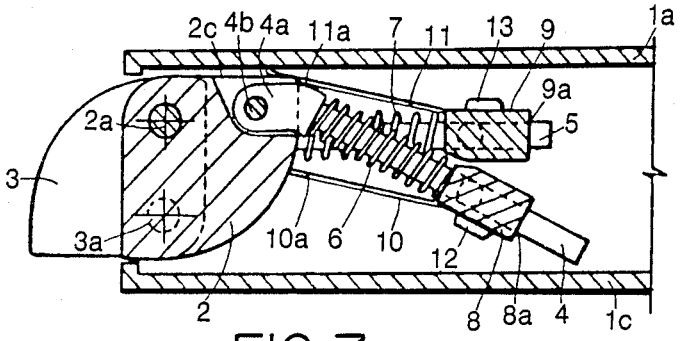
FIGS. 7(*a*)–(*c*) are partial, sectional views, showing sequential operations of the locking members and the return member when closing a door, FIG. 7(*a*) illustrating the door lock with the door completely opened, FIG. 7(*b*) illustrating the door lock with the door partially closed, and FIG. 7(*c*) illustrating the door lock with the door completely closed.
Figure 7B:
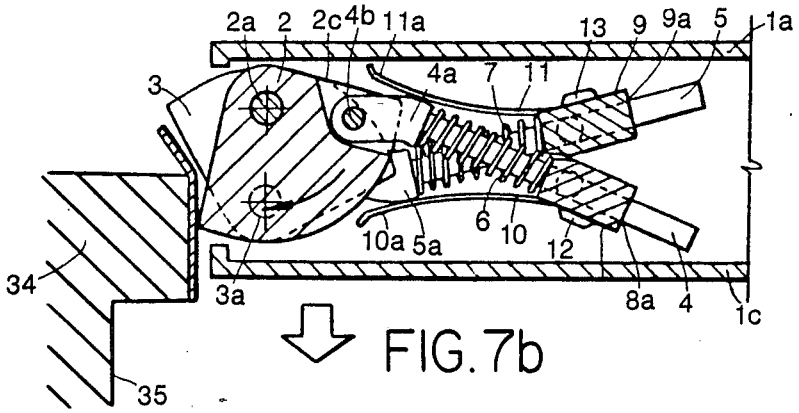
Figure 7C:
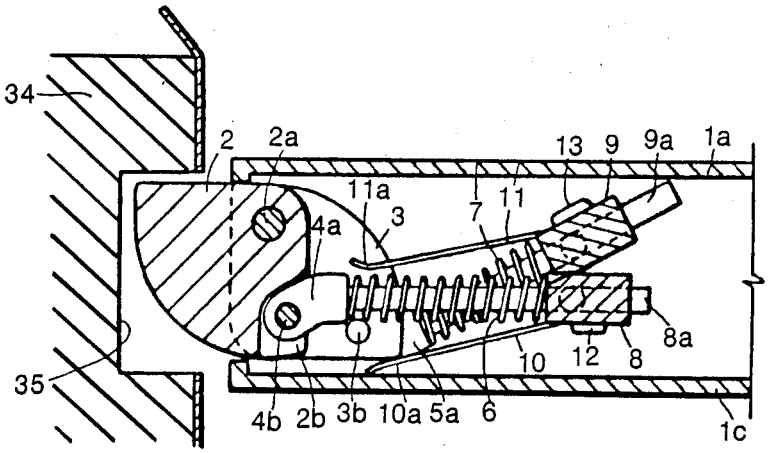

In FIGS. 6, 7 and 9, the reference numeral 34 designates a door frame and the reference numeral 35 designates a groove formed in the door frame 34. The numerals 36 and 37 respectively represent a power supply for the magnetizing coil 19 and a switch for the power supply.

In the door lock of FIGS. 6, 7 and 9, the pair of locking members 2 are pivotable about the pins 2*a* and the return member 3 is pivotable about the pin 3*a* in a direction opposite to that of the locking members 2. Accordingly, when the door is in a closed position, the locking members 2 are extended outwardly from the housing 1 and engaged with the groove 35 of the door frame 34, while the return member 3 is retracted into the interior of the housing 1, as shown in FIG. 6*a*. In this state, the connecting rods 4, connected to the locking members 2, are biased in a clockwise direction by the coil spring 6 to pivot about the pin 4*b* while the locking member 2 is maintained in engagement with the groove 35. In this condition, when the door is opened in the direction indicated by an arrow C in FIG. 6*b*, each locking member 2 is pushed against a side edge of the groove 35 and pivots in counterclockwise direction about the pivot pin 2*a* against the biasing force of the coil springs 6, thus causing the members 2 to retract into the housing 1. During the pivotal movements of the locking members 2, each of the connecting rods 4 slidably retracts through the hole 8*a* in the rod guide 8 and simultaneously, the guide 8 rotates in a clockwise direction about the pin 8*b*.

Until a center line of the pins 2*a* coincides with the axis of the respective connecting rod 4 during pivotal movement of the locking member 2 in its counterclockwise direction, the coil springs 6 continues to be compressed by the pivotal movement of the locking member 2. Once the center line of each pin 2*a* passes the axis of the respective connecting rods 4, the coil spring 6 urges the locking members 2 to pivot in the counterclockwise direction causing the locking member 2 to rapidly pivot out of engagement with the groove 35.

On the other hand, the pivotal movement of the rod guide 8 in the clockwise direction resulting from the movement of the connecting rod 4, make the free end 10*a* of the leaf spring 10 which is fixed to the rod guide 8 apply a biasing force to the return member 3, thereby pivoting the return member 3 outwardly from the housing 1. During the pivotal movement of the return member 3, the coil spring 7 around the connecting rod 5 functions in a manner similar to the coil springs 6 discussed above. Thus, when the door is completely opened, each locking member 2 is retracted into the housing 1 and maintained in the retracted position by the biasing force of the coil springs 6, while the return member 3 is extended outwardly from the housing 1 and maintained in the extended position by the biasing force of the coil spring 7.

As shown in FIGS. 7(*a*), 7(*b*) and 7(*c*), when the door is closed, the return member 3 is retracted into the housing 1. At that time, a sequence, reversed from that described above occurs, and the locking members 2 pivot outwardly from the housing 1 and engage the groove 35.

Figure 8A:
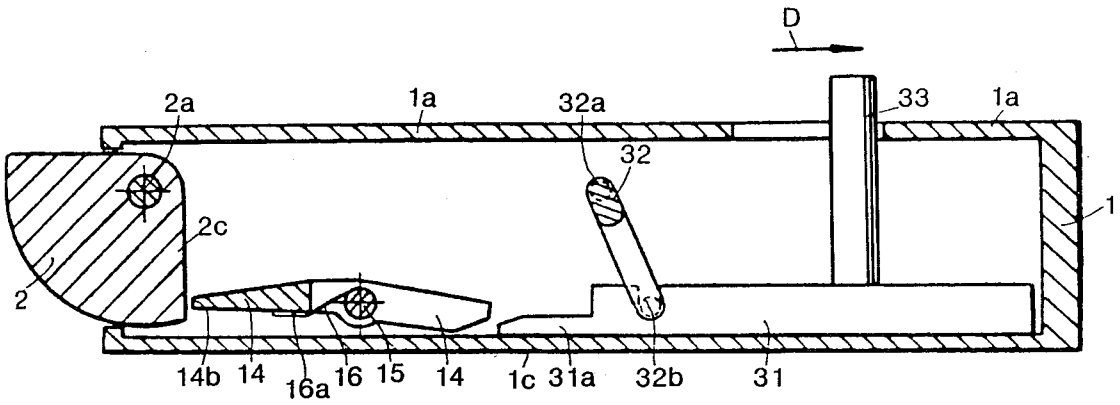
FIGS. 8(*a*)–(*b*) are partial, sectional views showing the construction and operation of the releasing means according to the invention, FIG. 8(*a*) illustrating the releasing lever is an engaged position, and FIG. 8(*b*) illustrating the releasing lever in a disengaged position.
Figure 8B:
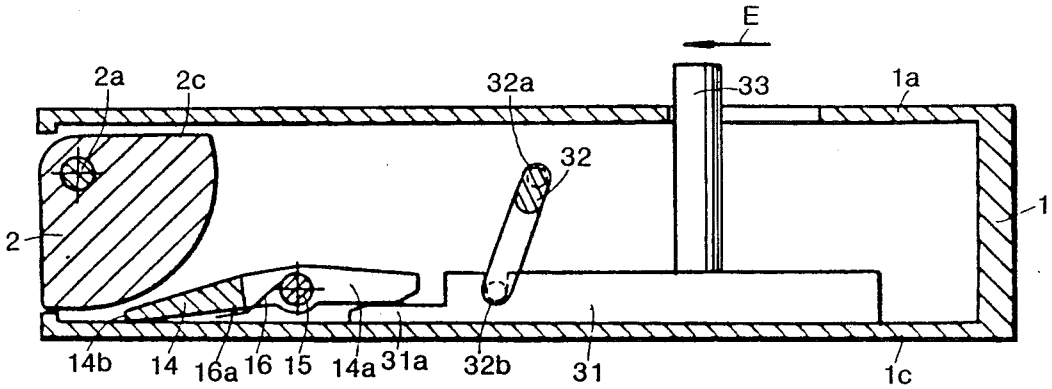

In order to use the door lock of this invention in such a locked state, the knob 33 of the releasing lever 31 is moved in the direction of the arrow D in FIG. 8*a*. By the movement of the knob 33, the releasing levers 31 are disengaged from the respective locking levers 14. Accordingly, when the door is in a closed position, the front end 14*b* of the locking levers 14 are maintained in engagement with the engaging surfaces 2*c* of the locking members 2 by the clockwise directed biasing force applied by the respective coil springs 16 to the locking levers 14. As a result, the locking members 2 can be disposed in a locked position. On the other hand, when the knob 33 of the releasing lever 31 is moved in the direction of the arrow E in FIG. 8*b*, the lever 31 is moved forward and the front end 31*a* of the releasing levers 31 forceably lift the rear ends 14*a* of the respective locking levers 14. Therefore, the locking levers 14 pivot about the pins 15 in a counterclockwise direction as shown in FIG. 8*b*. As a result, the front end of the levers 14 are released from the locking state with the engaging surfaces 2*c* of the locking members 2 and then, the locking members 2 are seated in an unlocked position. In this position, the door lock is automatically locked whenever the door is closed thereby eliminating the need to lock the door lock.

A method for automatically and/or manually unlocking the door lock with the releasing lever 33 in the locked position will now be described.

Figure 9A:
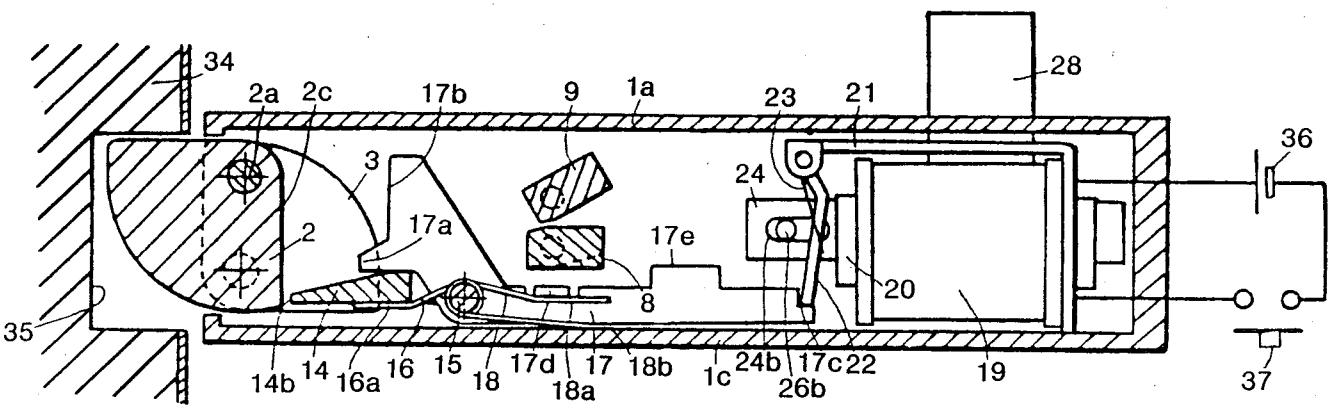
FIGS. 9(*a*) and (*b*) are partial, sectional views, showing the unlocking operation as effected by the automatic and/or manual unlocking means of the door, FIG. 9(*a*) illustrating the plate engaged with the actuating lever, and FIG. 9(*b*) illustrating the plate disengaged from the actuating lever.

In the locked position shown in FIG. 9*a*, the plate 22 is resiliently engaged with the shoulder 17*c* of each of the actuating levers 17 by means of the biasing force of the spring 23 acting on the levers 17. Accordingly, in this position, the actuating levers 17 cannot pivot about the pin 15 in spite of the biasing force of the coil springs 18 and will therefore not permit the locking levers 14 to disengage from the corresponding locking members 2.

Under these conditions, when current is supplied to the magnetizing coil 19 by closing the switch 37, a magnetizing force is generated in the magnetic core 20. The magnetizing force retracts the plate 22 toward the core 20, and disengages the plate 22 from the shoulder 17*c* of the actuating lever 17. The actuating levers 17 are now in a free state and pivot in a counterclockwise direction about the pins 15. During the pivotal movement of the actuating levers 17, the first protrusions 17*a* pivot in a counterclockwise direction against the locking portions 14*b* of the locking levers 14. This causes each locking lever 14 to pivot about its pin 15 into a position in which the locking levers 14 are disengaged from the engaging surfaces 2*c* of the locking members 2.

Figure 9B:
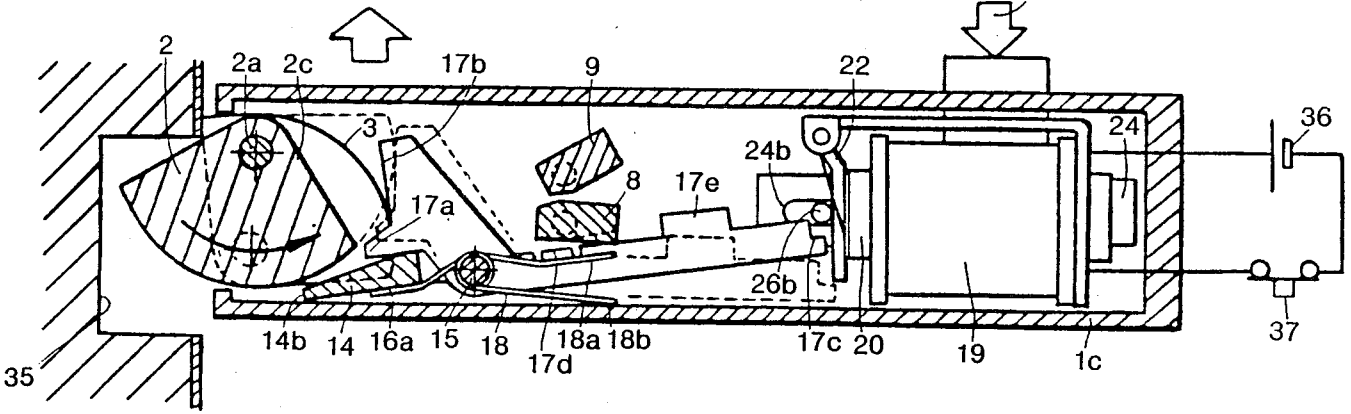

In this condition, when the door is opened, the locking members 2 may pivot in a counterclockwise direction and assume a position as illustrated in FIG. 9*b*. During the pivotal movement of the locking members 2, the curved surface of the locking members 2 push the second protrusion 17*b* of the respective actuating lever 17 causing the actuating lever 17 to rotate in a clockwise direction where the plate 22 is engaged with the shoulder 17*c* of the actuating lever 17.

Further, as the locking members 2 pivot in a counterclockwise direction as they strike the door frame 34, the return member 3 is extended from the housing 1. However, upon closing the door, the locking members 2 are projected from the housing 1 and locked by the locking lever 14.

To unlock the door lock manually, the push button 28 (FIG. 4) must be pushed in the direction of an arrow F as indicated in FIG. 9*b*. As best seen in FIG. 4, this action moves the cam 30 downwardly and the inclined surface 30*a* of the cam 30 slidably contacts the rear edge of the elongated slot 26*a* in the slider 26 and retracts the slider 26 to the right as viewed in FIG. 4 thus retracting the plate 22 out of engagement with the shoulder 17*c* of the actuating lever 17 permitting the door lock to be opened. Thus, in a manner similar to the automatic unlocking of the door lock, it is possible to unlock the door lock by manually operating the push button 28.

In accordance with the invention, the biasing force of the coil springs 6 around the connecting rods 4 is applied to the locking members 2 in the same direction as the pivotal movement of the locking members and the engaging surface 2*c* of the locking members does not apply force to the locking levers 14. Therefore, it is possible to disengage the locking lever 14 from the locking members 2 using only a minimum of magnetic force consuming only a small amount of electric power which can be conveniently supplied by a small DC battery.

As can be seen from the foregoing, the door lock of the present invention employs a novel returning means comprising a pair of locking members, a return member, rod guides, and leaf springs thereby eliminating the disadvantages encountered in the prior art door locks employing a roller type pivot member, which locks are also difficult to set in a door body because a portion of the pivot member protrudes from the lock housing when opening and/or closing the door.

It will be appreciated that in accordance with the present invention it is possible to minimize the thickness of the lock housing in order to provide an improvement in the appearance of the door lock. Further, the pair of locking members and the return member may be connected to each other to ensure reliable operation of the door lock.

While preferred embodiments of the invention have been described using specific terms and illustrations, such description is given for illustrative purposes only, and it is to be understood that variations and modification may be made without departing from the spirit or scope of the invention. It is intended that the scope of the invention be defined by the appended claims.

What is claimed is:

1. An electrically actuated door lock comprising:

a lock housing having opposed side walls;

a locking member pivotally mounted between the opposed side walls whereby said locking member is operable to pivot out of and retract into said lock housing;

a return member pivotally mounted in said housing whereby said return member is operable to pivot out of and retract into said lock housing;

a first connecting rod having one end connected to said locking member;

a second connecting rod having one end connected to the return member;

a first rod guide pivotally connected between the opposite side walls and having means for slidably receiving another end of said first connecting rod;

a second rod guide pivotally connected between said opposed side walls and having means for slidably receiving another end of said second connecting rod;

a first biasing means, cooperating with said first connecting rod, for applying a bias force against said locking member;

a second biasing means, cooperating with said second connecting rod, for applying a biasing force against said return member;

a first spring, fixed at one end thereof to the first rod guide and at another end thereof contactable with a surface of said return member;

a second spring fixed at one end thereof to the second rod guide and at another end thereof contactable with a surface of said locking member;

a locking lever disposed adjacent to said locking member and operable for engaging an engaging surface of said locking member to maintain said locking member in a locked position; an actuating lever operable for disengaging said locking lever from the engaging surface, said actuating lever having a shoulder at its rear end, said locking lever and said actuating lever being pivotally mounted in said housing;

means for applying a biasing force in one direction to said locking lever and for applying a biasing force in a reversed direction to said actuating lever;

an electrically operable plate for engaging the shoulder of the actuating lever;

a manually operable means, disposed adjacent to and operable for moving the electrically operable plate; and a longitudinally movable releasing lever disposed adjacent said locking lever.

2. The door lock according to claim 1, further comprising a pair of locking members and a pair of first connecting rods for said locking members and wherein said first biasing means further comprises means for applying a bias force to each of said locking members in the same direction as that of the pivotal movement of said members.

3. The door lock according to claim 1, wherein said first and second rod guides pivot according to the movement of said first and second connecting rods respectively, and wherein the first and second springs are respectively operable to pivot the locking member and the return member.

4. The door lock according to claim 1, wherein said locking lever is biased by a first spring means towards engagement with the engaging surface of said locking member, and wherein said actuating lever is biased by a second spring means in a direction to cause disengagement between said locking lever and said engaging surface and wherein said actuating lever has a first protrusion for unlocking the locking lever and a second protrusion having an edge on which a circumferential surface of said locking member is slidable.

5. The door lock according to claim 1, wherein said manually operable means comprises a member having an intermediate portion with a pair of vertically aligned slots and a guide slot, a slider disposed in said member and means for biasing said slider in said member, said slider having a protrusion extending through said guide slot, and a push button having a cam movably inserted into said vertically aligned slots of said member and a slot of said slider, said cam having an inclined surface adapted to contact an edge of said slot of the slider, whereby movement of the push button causes said protrusion to retract said plate.

6. The door lock according to claim 1, wherein said releasing lever is pivotally secured in said lock housing and has an end adapted to engage said locking lever and a knob for manually manipulating said releasing lever to either lock or unlock said locking lever.

* * * * *